US008292636B2

(12) United States Patent
Hsieh et al.

(10) Patent No.: US 8,292,636 B2
(45) Date of Patent: Oct. 23, 2012

(54) PIN HEADER CONNECTOR

(75) Inventors: Ming-Chih Hsieh, Tu-Cheng (TW); Tsung-Hsi Li, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/094,775

(22) Filed: Apr. 26, 2011

(65) Prior Publication Data

US 2012/0225594 A1 Sep. 6, 2012

(30) Foreign Application Priority Data

Mar. 4, 2011 (TW) ..... 100107468

(51) Int. Cl.
*H01R 12/00* (2006.01)

(52) U.S. Cl. ..... 439/74

(58) Field of Classification Search ..... 439/74
See application file for complete search history.

(56) References Cited

U.S. PATENT DOCUMENTS 5,700,151 A * 12/1997 Korsunsky et al. ..... 439/74
6,893,285 B1 * 5/2005 Chiang ..... 439/378
7,108,567 B1 * 9/2006 Korsunsky et al. ..... 439/701
7,445,467 B1 * 11/2008 Matsuo ..... 439/74

* cited by examiner

*Primary Examiner* — Phuong Dinh
(74) *Attorney, Agent, or Firm* — Altis Law Group, Inc.

(57) ABSTRACT

A pin header connector includes a number of electrically conductive pins, two insulating plates, and a supporting body. The pins are arranged in two parallel rows. Each of the rows comprises at least three pins. Each of the insulating plates defines a number of through holes corresponding to the pins. Each of the pins extends through the corresponding through hole. The supporting body defines slots accommodating the respective pins. The supporting body is sandwiched between the insulating plates.

3 Claims, 2 Drawing Sheets

PIN HEADER CONNECTOR

BACKGROUND

1. Technical Field

The present disclosure relates to board-to-board electrical connector assemblies, and particularly to a pin header connector for use in a board-to-board electrical connector assembly.

2. Description of Related Art

Board-to-board connector assemblies are widely used in liquid crystal monitors, LCDs, liquid crystal TVs, servers, and switches for electrically connecting two parallel arranged circuit boards. The board-to-board connector may include a pin header connector and a pin header socket for accommodating the pin header connector. The pin header connector includes a plurality of electrically conductive pins with their end portions inserted in the pin header connector. Lengths of the pins may vary according to distances between the two circuit boards. However, the pins may be bent or even broken off by pressure applied to two circuit boards when the pins are too long.

Therefore, a pin head connector is desired to overcome the above-mentioned shortcomings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Various embodiments will now be described in detail below with reference to the drawings.

Figure 1:
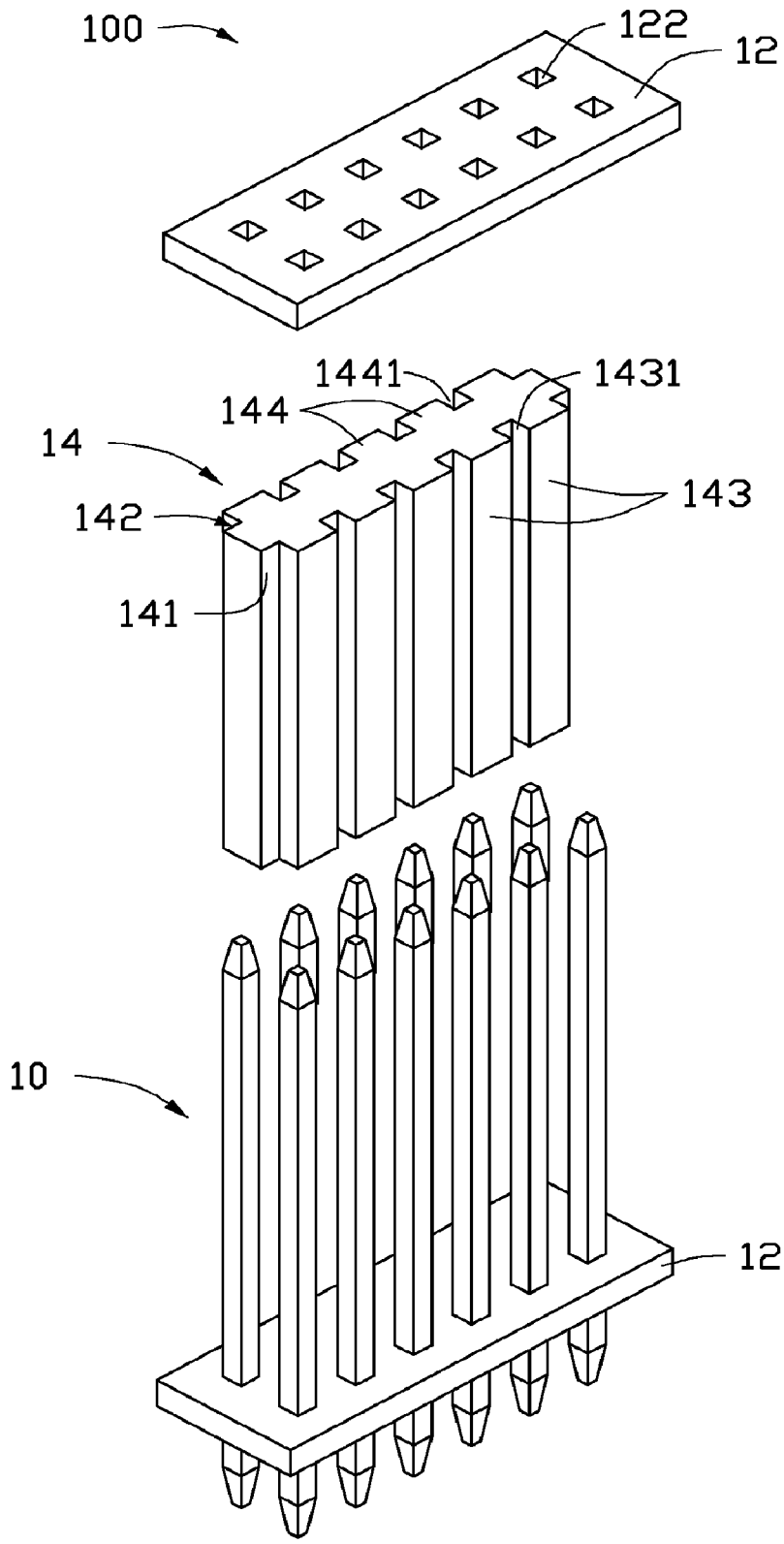
FIG. 1 is a schematic, disassembled view of a pin header connector in accordance with an exemplary embodiment.
Figure 2:
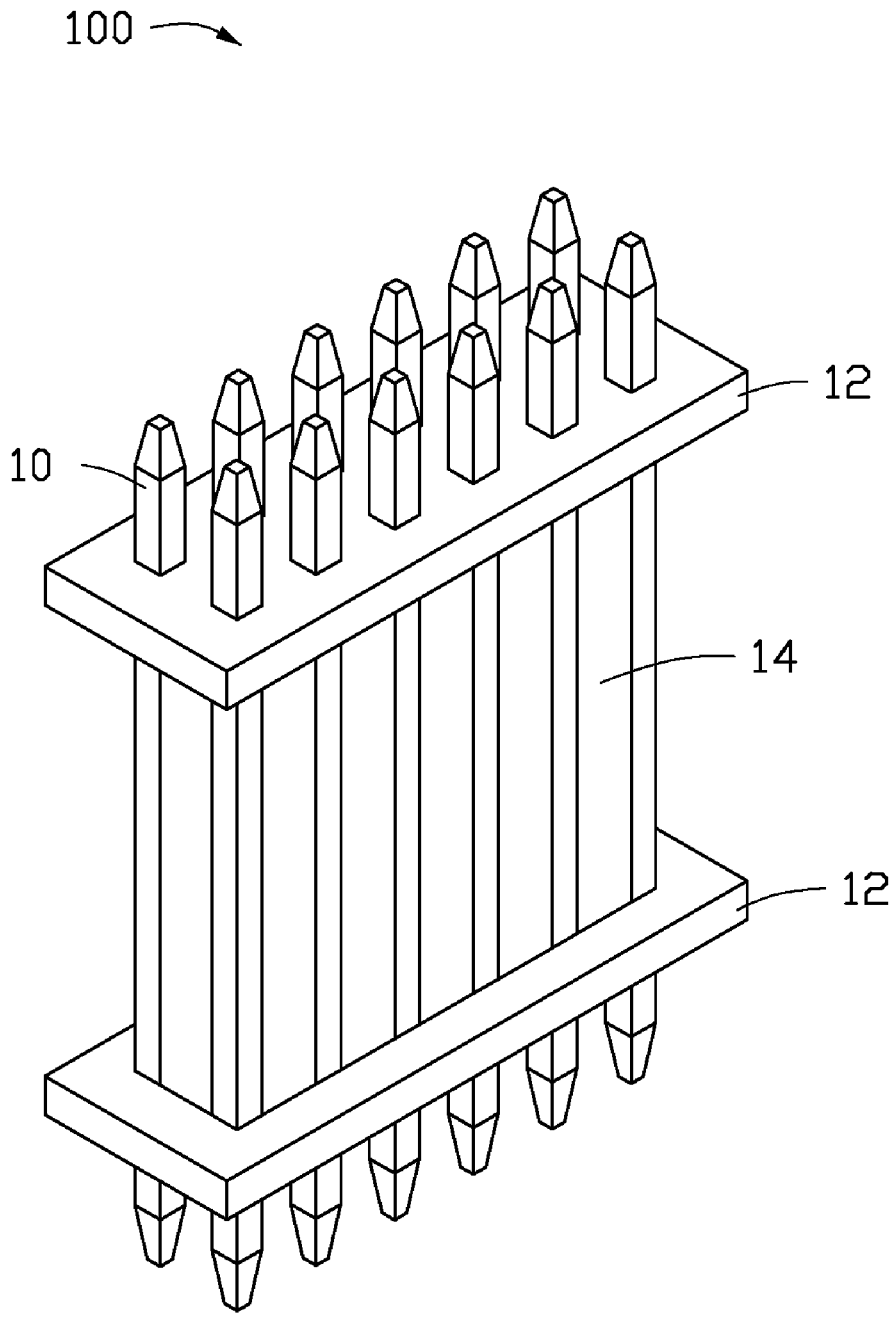
FIG. 2 is a schematic, assembled view of the pin header connector in FIG. 1.

Referring to FIGS. 1 and 2, a pin header connector 100 in accordance with an exemplary embodiment includes a plurality of electrically conductive pins 10, two insulating plates 12, and a supporting body 14.

The pins 10 are straight, and are arranged in two parallel rows. Each row of pins 10 includes at least three pins 10. In this embodiment, there are six pins 10 in each row. The pins 10 are configured for electrically connecting two circuit boards (not shown) together.

The insulating plates 12 may be made of plastic. Each of the insulating plates 12 defines a number of through holes 122 corresponding to the pins 10. Ends of each of the pins 10 extend through the corresponding through holes 122 as seen in FIG. 2. In this embodiment, the two insulating plates 12 are respectively adjacent to opposite ends of each of the pins 10.

The supporting body 14 is positioned between the two insulating plates 12 and sandwiched between the two rows of pins 10. The supporting body 14 includes a first surface 141 and a second surface 142 facing away from the first surface 141. The first surface 141 faces toward one row of pins 10 and the second surface 142 faces toward the other row of pins 10. A plurality of first protrusions 143 protrude from the first surface 141. Each two adjacent first protrusions 143 define a first slot 1431 therebetween. The first slot 1431 extends from one insulating plate 12 to the other. A plurality of second protrusions 144 protruding from the second surface 142. Each two adjacent second protrusions 144 define a second slot 1441 therebetween. The second slot 1441 extends from one insulating plate 12 to the other. The pins 10 are accommodated in the first slots 1431 and the second slots 1441. In this embodiment, the body 14 is rectangular and just large enough to encompass all the pins 10. Preferably, a distance between the insulating plates 12 is longer than entirely exposed portions of the pins 10. In this way the pins 10 can be quite long to traverse a distance between two components, and because only short portions are entirely exposed, the pins 10 cannot easily be bent or broken. The arrangement and number of the first slots 1431 and the second slots 1441 are set according to the number of pins 10.

A method for assembling the pin header connector 100 is as follows. Firstly, ends of the pins 10 are extended through the corresponding through holes 122 of one of the insulating plates 12. The insulating plate 12 is positioned adjacent to one end portion of the pins 10. Secondly, the supporting body 14 is installed with all the longer portions of the pins 10 extending from the one of the insulating plates 12 received in the first slots 1431 and the second slots 1441. Finally, the ends of the pins 10 extending from the end of the supporting body 14 opposite to the one of the insulating plates 12 are extended through the corresponding holes 122 of the other one of the insulating plates 12. Thus, the pin header 100 is obtained.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure.

The invention claimed is:

1. A pin header connector, comprising:

a plurality of electrically conductive pins, the pins arranged in two parallel rows, each of the rows comprising at least three pins;

two insulating plates, each of the insulating plates defining a plurality of through holes corresponding to the pins, each of the pins extending through the corresponding through hole; and a supporting body positioned between the two insulating plates and sandwiched between the two rows of pins, wherein the supporting body includes opposite surfaces each having a plurality of protrusions protruding therefrom, each two adjacent protrusions define a slot therebetween, the slot extends from one of the insulating plates to the other, and the pins are respectively accommodated in the slots.

2. The pin header connector of claim 1, wherein opposite ends of each of the pins are exposed and extend out of the through holes.

3. The pin header connector of claim 2, wherein a distance between the insulating plates is longer than entirely exposed portions of the pins.

* * * * *